US007661219B1

(12) United States Patent
Knight, Jr. et al.

(10) Patent No.: US 7,661,219 B1
(45) Date of Patent: Feb. 16, 2010

(54) AMBIDEXTROUS BOLT CATCH FOR FIREARMS

(75) Inventors: C. Reed Knight, Jr., Vero Beach, FL (US); Matthew A Callaghan, Titusville, FL (US)

(73) Assignee: Knights Armament Company, Titusville, FL (US)

( * ) Notice: Subject to any disclaimer, the term of this patent is extended or adjusted under 35 U.S.C. 154(b) by 481 days.

(21) Appl. No.: 11/760,348

(22) Filed: Jun. 8, 2007

Related U.S. Application Data

(60) Provisional application No. 60/879,639, filed on Jan. 10, 2007.

(51) Int. Cl.
*F41A 17/34* (2006.01)
*F41A 3/42* (2006.01)

(52) U.S. Cl. ..... 42/70.02; 42/17; 89/138

(58) Field of Classification Search ..... 42/16, 42/17, 70.01, 70.02; 89/137, 138, 153, 180, 89/181, 190
See application file for complete search history.

(56) References Cited

U.S. PATENT DOCUMENTS

| | | | | | |
|---|---|---|---|---|---|
| 1,651,128 | A | * | 11/1927 | Jervey | 89/137 |
| 2,538,799 | A | * | 1/1951 | Phillips et al. | 89/138 |
| 2,571,132 | A | * | 10/1951 | Harvey | 42/69.03 |
| 3,447,417 | A | * | 6/1969 | Civolani | 89/182 |
| 3,540,142 | A | | 11/1970 | Vartanian et al. | |
| 3,750,531 | A | | 8/1973 | Angell et al. | |
| 4,057,003 | A | * | 11/1977 | Atchisson | 89/138 |
| 4,128,042 | A | * | 12/1978 | Atchisson | 89/138 |
| 4,429,479 | A | | 2/1984 | Johnson | |
| 4,481,863 | A | * | 11/1984 | Zanner et al. | 89/138 |
| 4,521,985 | A | | 6/1985 | Smith et al. | |
| 4,615,134 | A | | 10/1986 | Beretta | |
| 5,513,460 | A | * | 5/1996 | Van Niekerk et al. | 42/70.06 |
| 5,519,954 | A | | 5/1996 | Garrett | |
| 5,636,465 | A | | 6/1997 | Johnson | |
| 5,726,376 | A | | 3/1998 | Menges et al. | |
| 5,741,996 | A | | 4/1998 | Ruger et al. | |
| 6,257,114 | B1 | | 7/2001 | Murello | |
| 6,851,346 | B1 | * | 2/2005 | Herring | 89/1.4 |
| 7,047,864 | B2 | | 5/2006 | Spinner et al. | |
| 7,103,998 | B2 | | 9/2006 | McGarry | |
| 2003/0208940 | A1 | | 11/2003 | Johnson | |
| 2005/0000138 | A1 | | 1/2005 | Kiss | |
| 2006/0123683 | A1 | | 6/2006 | Garrett et al. | |

* cited by examiner

*Primary Examiner*—Bret Hayes
(74) *Attorney, Agent, or Firm*—Brian S. Steinberger; Joyce Morlin; Law Offices of Brian S. Steinberger, P.A.

(57) ABSTRACT

An ambidextrous bolt catch device, apparatus, system and methods for using are provided. Four main components include a bolt catch finger, lever system and plunger rod assembly with torsion spring. The lever system includes a right release lever and a left release lever; the left lever is an integral part of the bolt catch finger. The plunger rod assembly abuts and connects the right and left levers; a torsion spring on the rod creates tension causing rotation of the bolt catch finger in a downward or upward position. In an upward position, the bolt catch finger engages the bolt, retains the bolt in a rearward position, and signals the operator that the magazine is empty. The bolt engaged by the finger is held rearward in a safe, reliable manner to allow an unobstructed view of the firearm chamber until manually released using either the right or left release lever.

18 Claims, 7 Drawing Sheets

AMBIDEXTROUS BOLT CATCH FOR FIREARMS

This invention claims the benefit of priority of U.S. Provisional Patent Application Ser. No. 60/879,639 filed Jan. 10, 2007.

FIELD OF THE INVENTION

The present invention relates to a firearm, and particularly, to an ambidextrous bolt catch device, apparatus, system and method on a semi-automatic or fully automatic firearm that retains the bolt and bolt carrier mechanism in a rearward position.

BACKGROUND AND PRIOR ART

Bolt catch devices for hand-held firearms are known in the art, especially in handguns and combat rifles. The purpose of a bolt catch device on any firearm is to retain the principal members of the bolt or bolt carrier mechanism in a rearward position. The rear-hold position is desirable as a safety measure to allow an unobstructed view of the chamber of a firearm; to provide access to the chamber area for cleaning or clearing an obstruction, or other maintenance; as a signal to the operator that the magazine is empty; and to provide a means for rapid reloading, by holding the bolt group to the rear while the empty magazine is removed and a new magazine is installed.

Some members of the M16/M4 family of firearms have a bolt catch that is actuated so that it holds the bolt group rearward after the last round is fed from the magazine.

When the bolt catch device is actuated manually the bolt group is released and allowed to move forward under spring pressure, chambering the first round from a new magazine.

On most firearms the bolt catch is located on one side of the receiver, making it difficult and sometimes impossible to actuate with a single hand while aiming the firearm. On the M16/M4 rifle, for example, the bolt catch is on the left side of the receiver where actuation is generally accomplished with the palm of the left hand, when the firearm is held on the right shoulder. The design of the M16/M4 bolt catch is such that it is a single element functioning at one end as the component holding the bolt group rearward and at the other end offering a knurled protrusion on the end of a lever as a point for actuation.

Ambidextrous bolt catches are found almost exclusively on semi-automatic pistols, and take the form of a latch or other device that keeps the slide to the rear after the last round is fired.

The known prior art includes several patents describing bolt catch device arrangements for firearms or ambidextrous magazine catch and release mechanisms that are used in a clip change when the last round is fired from a magazine. The function of a bolt catch device is significantly different than the function of a magazine catch, but the use of an ambidextrous means for operating each mechanism is the reason for including such prior art in the list below.

U.S. Pat. No. 3,540,142 to Vartanian et al. describes a bolt stop mechanism for a semi-automatic firearm with a spring that engages the bolt stop to bias against a pin. The bolt stop is pivotally mounted in the firearm receiver and is movable into and out of engagement with the bolt by pushing the end of the latch and releasing it.

U.S. Pat. No. 3,750,531 to Angell et al. requires a safety lever to be pushed up to a horizontal position, the action operates to lock the strike to prevent it from traveling down the striker tunnel in a dual protection safety device for semi-automatic pistol.

U.S. Pat. No. 4,429,479 to Johnson describes a magazine latch release mechanism for repeating rifles.

U.S. Pat. No. 4,521,985 to Smith et al. shows an ambidextrous magazine release.

U.S. Pat. No. 4,620,134 to Beretta describes a retaining mechanism for rifle magazines, wherein a hook is engaged in the slot of a magazine that is fixed to a spring-loaded arm located transversely in the body of the weapon; the hook can be operated from both sides of the weapon.

Garrett in U.S. Pat. No. 5,519,954 uses two springs, houses the pivoting mechanism in a protruding base and is specifically designed for use as an ambidextrous magazine release.

U.S. Pat. No. 5,636,465 to Johnson describes a spare magazine carrier. FIG. 8 shows a plunger mounted within a tubular housing and biased outwardly, or leftward, by a helical spring surrounding a portion of the plunger.

U.S. Pat. No. 5,726,376 to Menges et al. in FIG. 1 shows locking levers with catching shoulders to prevent accidental firing of weapon.

U.S. Pat. No. 5,741,996 to Ruger et al. in FIG. 2 shows a slide and a slide stop latch.

U.S. Pat. No. 6,257,114 to Murello describes a firing lever mechanism for firearms with a locking lever pivotally mounted that cooperates with a slide and stop pin that is engaged to lock the slide into position.

U.S. Pat. No. 7,047,864 to Spinner et al. FIG. 4 and FIG. 5 show a magazine shaft with cross boring, swivel shaft with levers, a catch on lever, left-handed shooter holding the weapon with left hand can now press on the pivoting lever and release the slide unit for forward movement.

U.S. Pat. No. 7,103,998 to McGarry describes a camblock assembly for a firearm having a guide rod to resist movement of a reciprocating slide.

U.S. Patent Publ. No. 2003/0208940 to Johnson describes a bolt catch operating lever attached to the left side of receiver with a pivot pin. The bolt catch engages the bolt to hold it in a rearward position using a detachable lateral extender mechanism; lever is pressed to the right, the catch is disengaged and releases the bolt that is moved forward by a spring.

U.S. Patent Publ. No. 2005/0000138 to Kiss in FIG. 2 and FIG. 5 shows a bolt catch device pivotally mounted on a rivet; the lever connects with and transverse the channel shaped receiver with bottom wall; there is a return spring; a sensor lever rotates the catch device upward; the head of the lever is returned by spring forces of the magazine and inhibits the forward movement of the carrier locking the bolt carrier.

Garrett in U.S. Patent Publication 2006/0,123,683 describes an ambidextrous magazine catch having a rod with a threaded portion that is pivotally attached to a lever and guided transversely through an orifice. The ambidextrous magazine catch has a single spring, engages and disengages the magazine slot of magazine by depressing lever.

The above patents disclose the state of the art in relation to bolt catch devices and ambidextrous magazine catches or releases for firearms; however, with regard to bolt catch devices, there is still a need for an ambidextrous, quick, easy to secure, reliably functioning bolt catch device to retain the bolt and bolt carrier mechanism in a rearward position after the last round is fed from the magazine.

Improvements are needed so that a bolt catch device can be engaged with ease and dexterity with one hand by either a right-handed shooter or a left-hand shooter of a weapon. Such an improvement saves valuable time in the field and significant costs in inventory. There is no longer a need for different weapon assemblies based on whether a shooter is right-handed or left-handed. Such improvements will mean that weapons are safer and universally acceptable to all users; the present invention meets these needs.

SUMMARY OF THE INVENTION

The present invention, which shall be subsequently described in greater detail, provides a new bolt catch device designed to provide an ambidextrous, safe, reliable, easily activated method for retaining the bolt group in a rearward position compared to previous types. The design and precision with which the bolt catch device of the present invention is made contributes many advantages over the prior art. The new and novel features include, but are not limited to, a vertical lever pin in an effective arrangement of three other components: a bolt catch finger, a lever, a plunger rod with a spring and plunger head for use principally, but not limited to, the M16/M4 family of rifles.

The first objective of the present invention is to provide an ambidextrous bolt catch device that can be operated from both the left and right sides of a firearm.

The second objective of the present invention is to provide an ambidextrous bolt catch device that can be actuated with one hand.

The third objective of the present invention is to provide an ambidextrous bolt catch device for easy use by either a right-handed shooter or a left-handed shooter of a firearm.

The fourth objective of the present invention is to provide an ambidextrous bolt catch device for a firearm that allows an unobstructed view of the empty chamber of a firearm.

The fifth objective of the present invention is to provide an ambidextrous bolt catch device for a firearm that permits unobstructed access to the chamber area for cleaning or clearing an obstruction.

The sixth objective of the present invention is to provide an ambidextrous bolt catch device for a firearm for the M16/M4 family of weapons.

The seventh objective of the present invention is to provide an ambidextrous bolt catch device for a firearm that provides a signal to the operator that the magazine is empty.

The eighth objective of the present invention is to provide an ambidextrous bolt catch device for a firearm that facilitates the rapid reloading of a firearm by holding the bolt group to the rear while the empty magazine is removed and a new magazine is inserted.

An ambidextrous bolt catch device for firearms, including a bolt catch finger connected to a receiver of a firearm by a pivot pin, a first release lever located on a right side of the firearm and attached to the receiver of the firearm with a vertical pin, a second release lever located on a left side of the firearm and integral to the bolt catch finger, a plunger rod assembly having a first end abutting a base of the bolt catch finger on the left side of the firearm and a second end connected to the first release lever on the right side of the firearm, thus providing a fully assembled bolt catch device that holds the bolt and bolt carrier in a rearward position and releases the bolt and bolt carrier to move forward and chamber communication for the firearm.

The plunger rod assembly includes a torsion spring surrounding the first end of the plunger rod, held in place by a plunger head, the torsion spring creates tension and causes rotation of the bolt catch finger in a downward position when the first release lever and second release lever are pressed laterally toward the right side and the left side of the weapon and when the first release lever and second release lever are pulled laterally away from the right side and the left side of the firearm, the bolt catch finger rotates to an upward position.

The bolt catch finger can be shaped from a solid material. The solid metal is at least one of steel, stainless steel, and an iron alloy. The bolt catch finger can be fabricated using metal injection molding (MIM).

A method of preventing a bolt carrier of a firearm from moving forward after firing ammunition, the method can include steps of moving a first lever and a second lever of an ambidextrous bolt catch device that is attached to a firearm laterally away the first side and the second side of the firearm and simultaneously pushing a plunger rod against the bias of the spring that causes the rotation of a bolt catch finger in an upward position, blocking the forward motion of a bolt and bolt carrier by the bolt catch finger in a upward position.

The step of moving the first lever and the second lever is accomplished manually with one hand selected from at least one of a right hand and a left hand. The step of moving the first lever and the second lever is accomplished mechanically with the rearward movement of the bolt carrier and bolt after the last round of ammunition is fired.

A method of releasing a bolt carrier of a firearm for forward movement to chamber ammunition in a firearm, the method includes the steps of moving a first lever and a second lever of an ambidextrous bolt catch device that is attached to a firearm laterally toward the first side and the second side of the firearm and releasing pressure on the spring bias of the plunger rod causing the rotation of a bolt catch finger in a downward position, and releasing the bolt and bolt carrier to move forward and chamber ammunition in the firearm.

The step of moving the first lever and second lever can be accomplished manually with one hand selected from at least one of a right hand and a left hand.

A firearm with bolt catch firing system, can include a combination of a rifle having a magazine receptical and a removable magazine, a bolt catch finger connected to a receiver of the rifle by a pivot pin, a first release lever located on a right side of the rifle and attached to the receiver of the rifle with a vertical pin, a second release lever located on a left side of the rifle and integral to the bolt catch finger, and a plunger rod assembly having a first end abutting the base of the bolt catch finger on the left side of the rifle and a second end connected to the first release lever on the right side of the rifle, thus providing a fully assembled bolt catch device that holds the bolt and bolt carrier in a rearward position and releases the bolt and bolt carrier to move forward and chamber ammunition for the rifle.

The plunger rod assembly can include a torsion spring surrounding the first end of the plunger rod, held in place by a plunger head, the torsion spring creates tension and causes rotation of the bolt catch finger in a downward position when the first release lever and second release lever are pressed laterally toward the right side and the left side of the weapon and when the first release lever and second release lever are pulled laterally away from the right side and the left side of the rifle, the bolt catch finger rotates to an upward position.

The bolt catch finger can be shaped from a solid metal. The solid metal can include at least one of steel, stainless steel, and an iron alloy. The bolt catch finger can be fabricated using metal injection molding (MIM). The rifle can be a semi-automatic weapon. The rifle can be a fully automatic weapon, and can be selected from one of a M16 firearm and M4 firearm.

Further objects and advantages of this invention will be apparent from the following detailed description of a presently preferred embodiment, which is illustrated in the accompanying drawings.

BRIEF DESCRIPTION OF THE FIGURES

Referring particularly to the drawings for the purposes of illustration only, and not limitation.

DESCRIPTION OF THE PREFERRED EMBODIMENT

Figure 1:
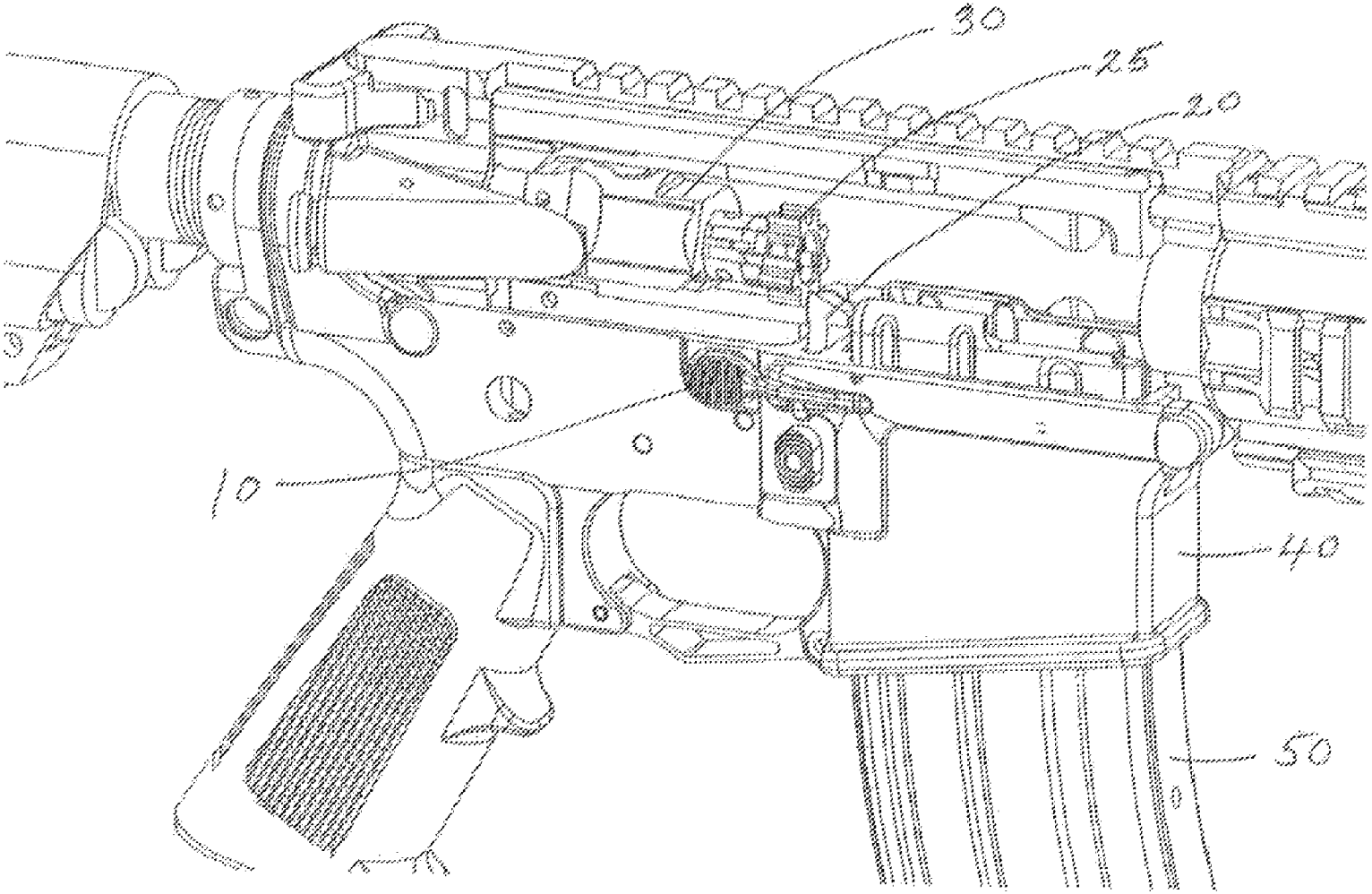
FIG. 1 is a side perspective view of an assembled ambidextrous bolt catch device with a bolt catch finger holding the bolt and bolt carrier in a rearward position.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

It would be useful to discuss the meanings of some words used herein and their applications. "Firearm" is used herein to refer to all weapons to which an ambidextrous bolt catch device can be installed, such as those having or capable of being manufactured with mounting holes in the receiver. A preferred weapon for installing the present invention is the M16/M4 family of weapons.

The directional terms "lateral," "horizontal," "vertical," "front," "forward," "rear," "rearward," "right," "left," "above," and "below" refer to the firearm when held in the normal firing position.

Listed below are the components of the ambidextrous bolt catch device assembly shown in FIGS. 1-7.

10 Bolt catch device on right side of firearm
12 Plunger
14 Spring
16 Plunger Head
18 Bolt catch device pin
19 Vertical lever pin
20 Bolt catch finger
22 Knurled pad of bolt catch device integral to bolt catch finger on left side of firearm
25 Bolt
28 Section of lower receiver that contains bolt carrier
30 Bolt carrier
40 Section of lower receiver to which magazine is attached
50 Magazine
150 Pivot pin
a hole in mid-section of right lever
b hole in distal end of right lever
c ninety degree bend in plunger rod
d threaded end of plunger rod
e through hole in lower receiver for plunger rod
f vertical hole in lower receiver that receives vertical lever pin
h horizontal movement to left of firearm
i horizontal movement to right within through hole e
j horizontal movement to right of firearm
k vertical movement in direction above firearm As state earlier, and shown in FIGS. 1-7, the ambidextrous bolt catch device of the present invention has four main components including a vertical lever pin that attaches and engages in an efficient manner a pivoting bolt catch finger with a knurled pad for hand control on the left side of a firearm; a plunger configuration with a plunger rod, a spring and plunger head that connect the right and left sides of the bolt catch device; and a bolt catch device for hand control on the right side of a firearm.

In FIG. 1, a bolt catch finger 20 is pivotally mounted on the lower receiver 40 of a firearm with a portion extending into the receiver to retain the bolt group, which is a combination of a bolt 25 and bolt carrier 30. The bolt catch finger 20 holds the bolt group in a rearward position. A lever 10 on the right side and a knurled pad 22 (not shown) on the left side are depressed separately, depending on whether the operator is left-handed or right-handed, to release the bolt group 25, 30 and allow its forward motion.

The right side view of a firearm in FIG. 1 shows the ambidextrous bolt catch assembly in the customary location of bolt catch assemblies, offering the advantage of user familiarity and component commonality. The bolt catch device 10 for the right handed user is positioned in the lower receiver 40 which holds ammunition in the magazine 50.

FIG. 1 also shows the bolt catch finger 20 in a raised position holding the bolt 25 and bolt carrier 30 in a rearward position. This is a signal to the user that the last round of ammunition has been fired.

Figure 2:
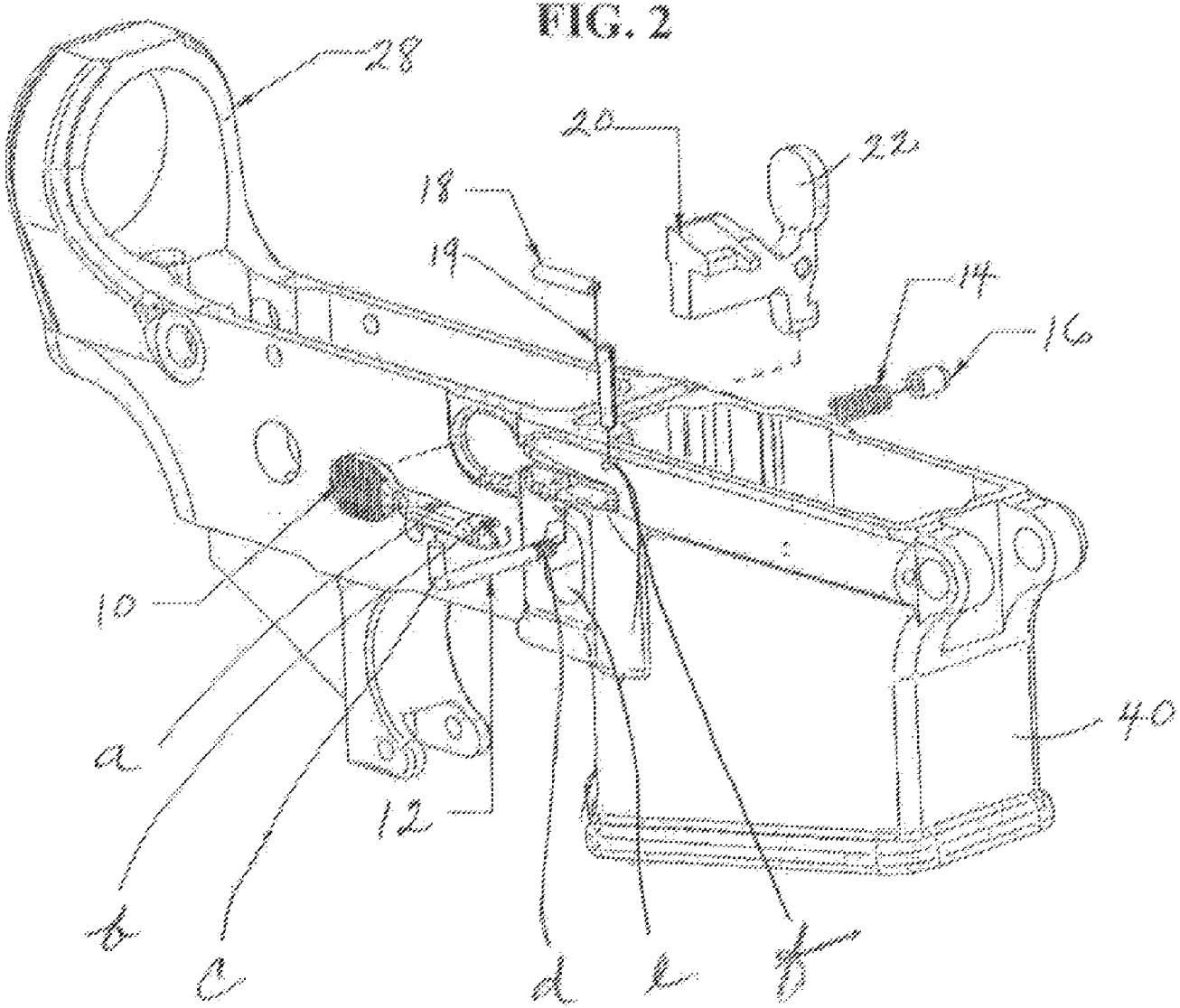
FIG. 2 is an exploded view of an ambidextrous bolt catch device in position for assembly in the receiver of a firearm.

FIG. 2 is an exploded view of the ambidextrous bolt catch device of the present invention as it would be assembled in a weapon. Bolt catch device 10 fits flush into the right side of the lower receiver 40 when the bolt catch finger is not engaged or in the raised position. The nesting of lever 10 in a pocket formed into the receiver 40 side wall eliminates a snag hazard for the shooter and prevents a potential problem in military or police operations. Lever 10 is rotationally fastened to the lower receiver 40 and also connected to the firearm by various pins and pivots.

FIG. 2 shows a vertical lever pin 19 that is held in place by a bolt catch pin 18. The vertical lever pin 19 passes through a first hole a in the mid-section of lever 10, pivotally mounting it to a vertical hole f in the lower receiver 40. A plunger rod 12 extends from the left side to the right side of the weapon; with a ninety degree bend c at the end connecting to the lever 10 by a second hole b, in the distal end of lever 10. The connection to lever 10 is opposite threaded end d of plunger rod 12.

Still referring to FIG. 2, the 90 degree bend c in the plunger rod 12 extends to and abuts the base of the bolt catch finger 20 thereby eliminating the need for a connecting pin and increasing the reliability of the system. The plunger rod 12 operates in a through-hole e in the lower receiver 40 on a plane that is perpendicular to the motion of the bolt group 25, 30. A spring 14 and plunger head 16 are fastened to the plunger rod 12 by a threaded interface d. The complete ambidextrous bolt catch assembly can be securely fitted to a weapon and will not be easily lost during disassembly.

Figure 3:
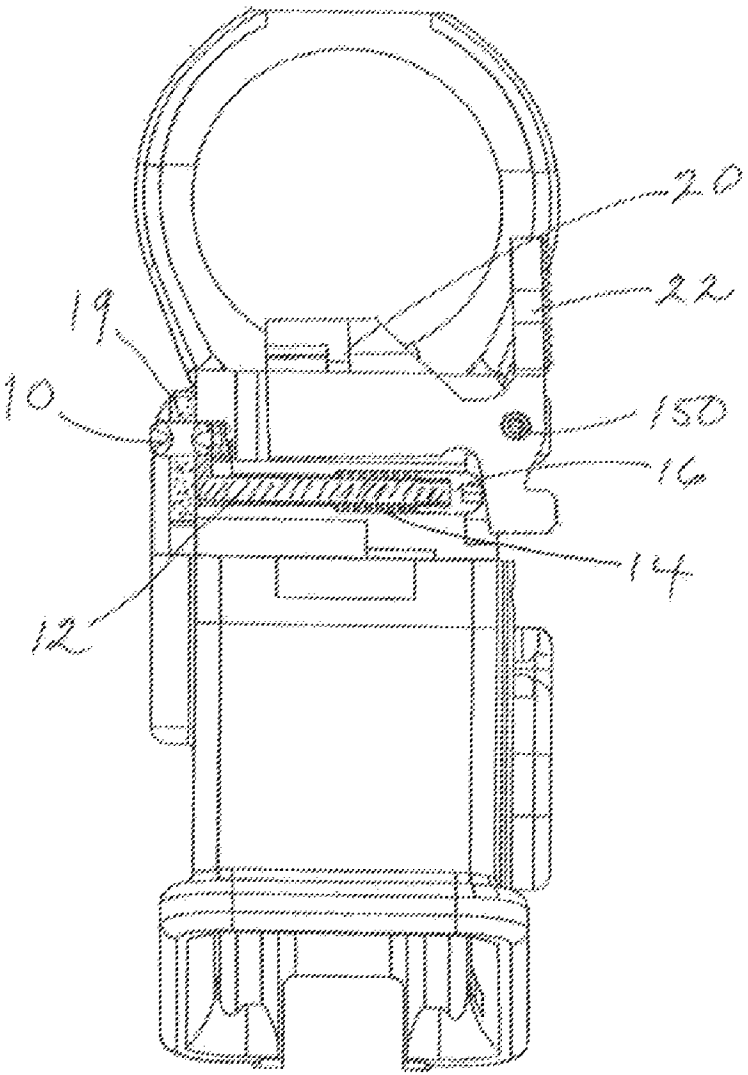
FIG. 3 is a front view of the assembled ambidextrous bolt catch device in lowered position allowing passage of the bolt group to and from the chamber during firing of ammunition from a magazine.

FIG. 3 is a front view of the assembled ambidextrous bolt catch of the present invention with the bolt catch 20 in a lowered position. After a round of ammunition is placed in the weapon, the user can use either the right-hand trigger finger to press lever 10 in the direction of the receiver 40 side wall, actuating vertical lever pin 19 to engage plunger rod 12 connected to spring 14 and plunger head 16 allowing the mechanics to rotate the bolt catch 20 in a downward rotation, which releases the bolt 25 (not shown).

Further reference to FIG. 3 shows that when the bolt catch finger 20 is in a downward position it partially obstructs the opening through which the bolt 25 and bolt carrier 30 move. The protruding portion is situated so that when the last round is fired, the bolt carrier group 25, 30 go over the top of the bolt catch finger 20 when it's in the downward position. Once the bolt carrier group slides over the empty magazine and the magazine follower rotates the bolt catch, it is now ready to stop the bolt before it comes forward again. When the bolt comes forward in the lower receiver the bolt catch will mate up with a "lug" on the bolt, thus preventing the bolt carrier from moving further forward.

Figure 4:
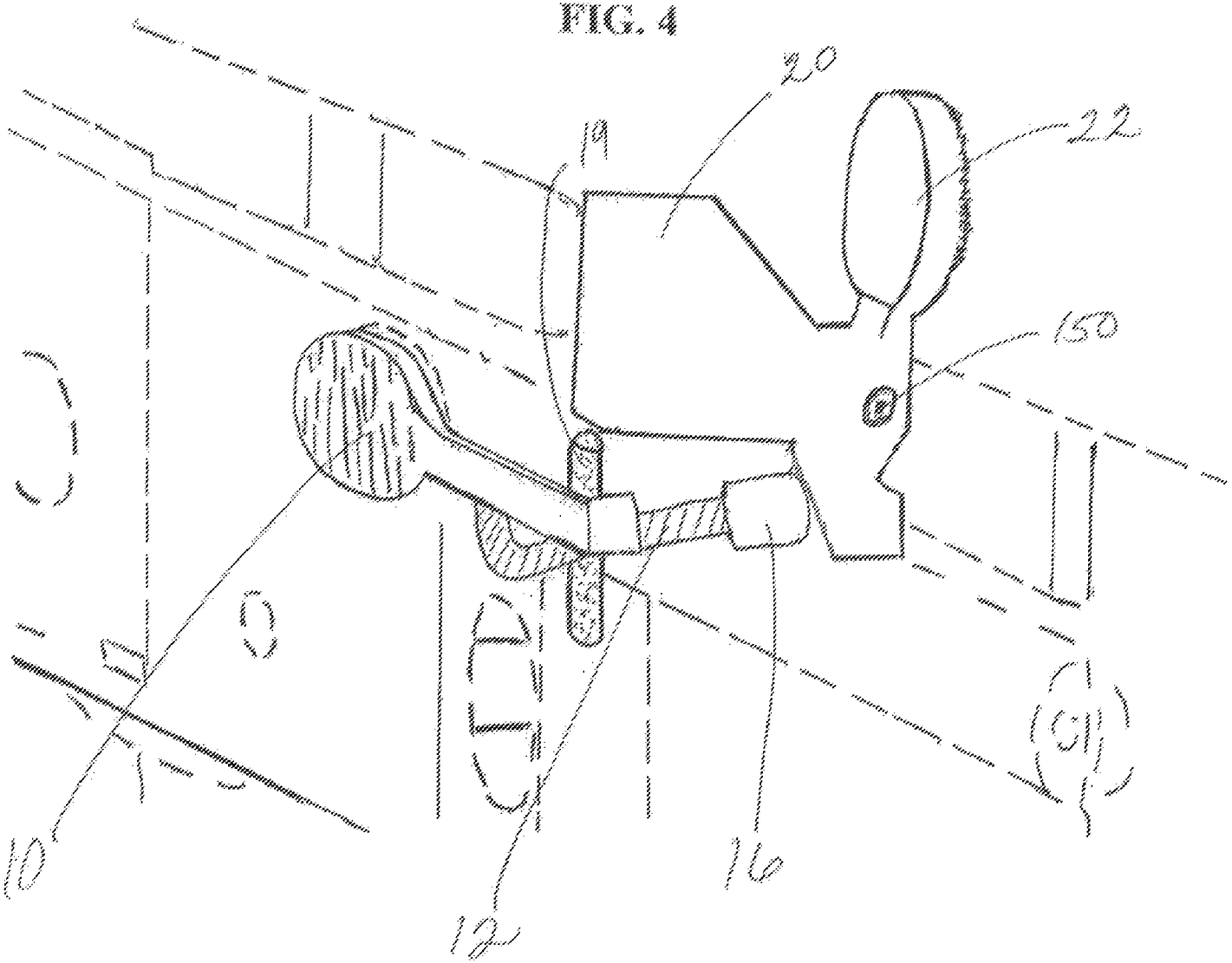
FIG. 4 is a perspective view of an ambidextrous bolt catch device showing major parts and positions for assembly in a firearm.

FIG. 4 is a perspective view of the ambidextrous bolt catch device showing the main components, the vertical lever pin 19 securing the bolt catch device 10 on the right side of the firearm to the indentation on the side of the weapon that houses or nests the lever 10, thus preventing snag hazard for the user. The plunger rod 12 connects lever 10 to the end with the ninety degree bend and extends to the opposite side of the weapon where the plunger head 16 abuts the base of the bolt catch finger 20 having an integrally formed knurled pad 22 mounted on the weapon with a pivoting hinge 150. The ambidextrous hand controls, lever 10 on the right side of the weapon and knurled pad 22 on the left side of the weapon are clearly shown in FIG. 4. It should be understood that the shape and surface treatment of the lever and knurled pad can be in any configuration known and used by persons skilled in the art of ergonomics and are not limited to the configurations shown herein.

Figure 5:
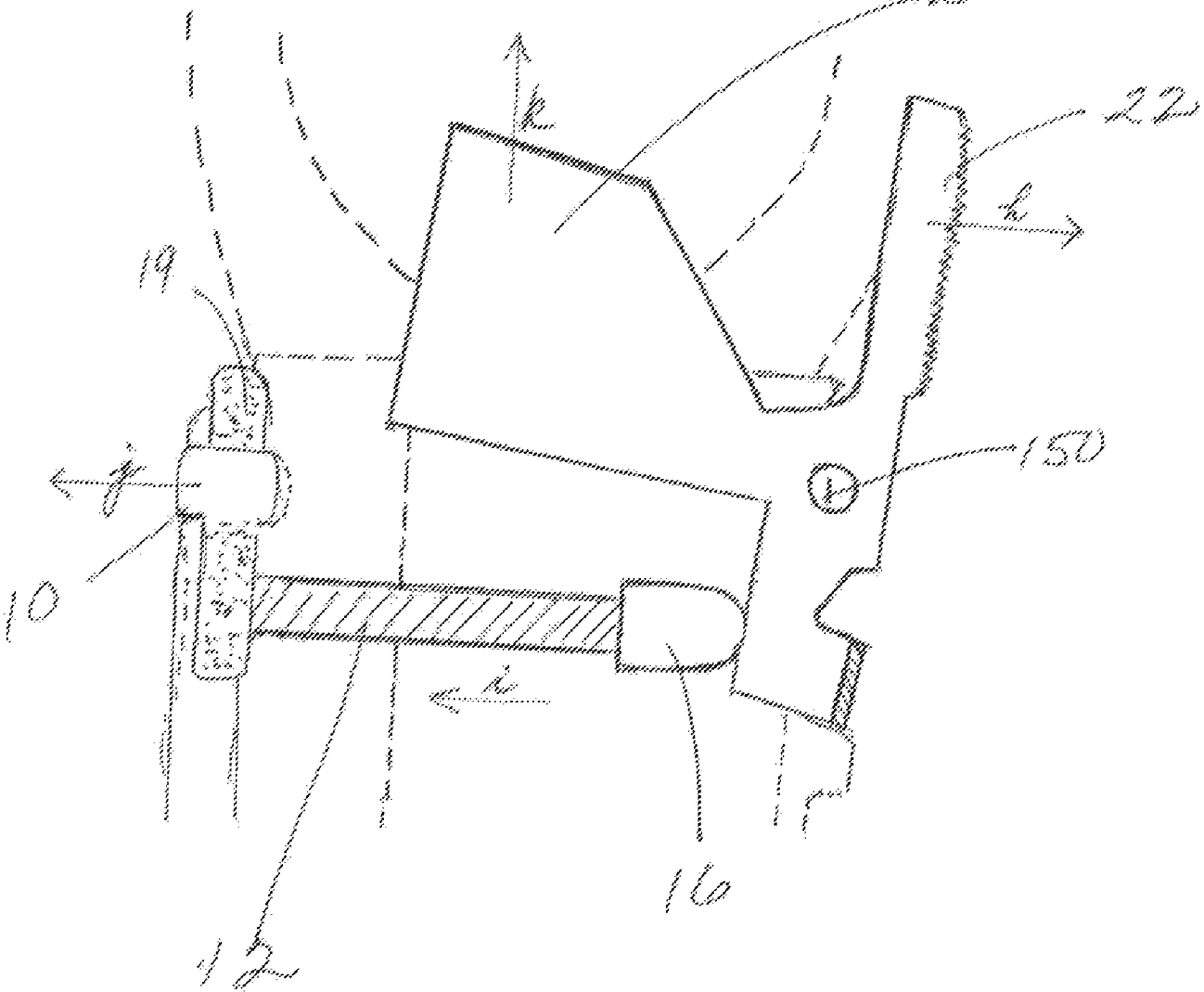
FIG. 5 is a front view of an assembled ambidextrous bolt catch device in raised position with directional arrows for moving parts.

FIG. 5 shows the bolt catch device with the bolt catch finger 20 rotating upward in the direction of arrow k. The bolt catch finger 20 will rotate upward when you have an empty magazine in the lower receiver 40. The bolt group passes over the magazine and the magazine spring pushes the magazine follower against the bolt catch finger, which creates the rotational action. Lever 10 is pushed outward when bolt catch finger 20 is rotated upward. When bolt catch finger 20 is rotated its flat surface pushes against plunger head 16 which is fastened to plunger rod 12. The resulting actions cause lever 10 to rotate outwards in the direction of arrow j.

Alternatively, the user can pull knurled pad 22 in the direction of arrow h or pull lever 10 away from the side of the weapon in the direction of arrow j. This motion of the hand controls causes the plunger rod 12 to move in the direction of arrow i creating mechanical leverage that raises the bolt catch finger 20 in such a manner that its stops the bolt group from moving forward, as shown in FIG. 7.

Figure 6:
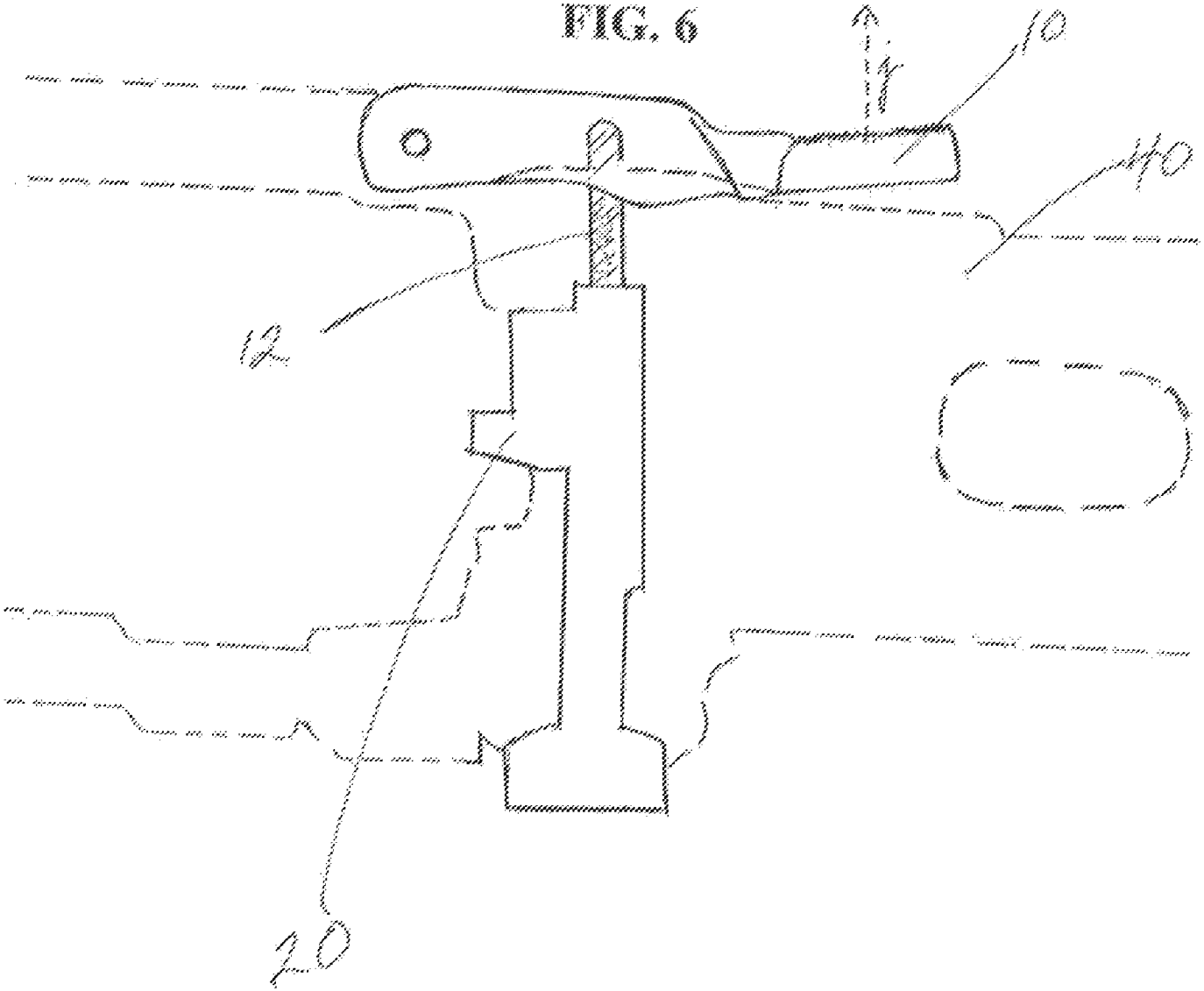
FIG. 6 is a top view of the ambidextrous bolt catch device of FIG. 5 showing movement of the lever on the right side the firearm in the direction of arrow j.

FIG. 6 is an enlarged drawing of a top view of the bolt catch device of the present invention when the bolt catch finger 20 is in the raised position and lever 10 on the right side has pivoted outwards in the direction of arrow j. FIG. 6 shows that lever 10 does rotate outward, but not very far from the lower receiver 40.

Figure 7:
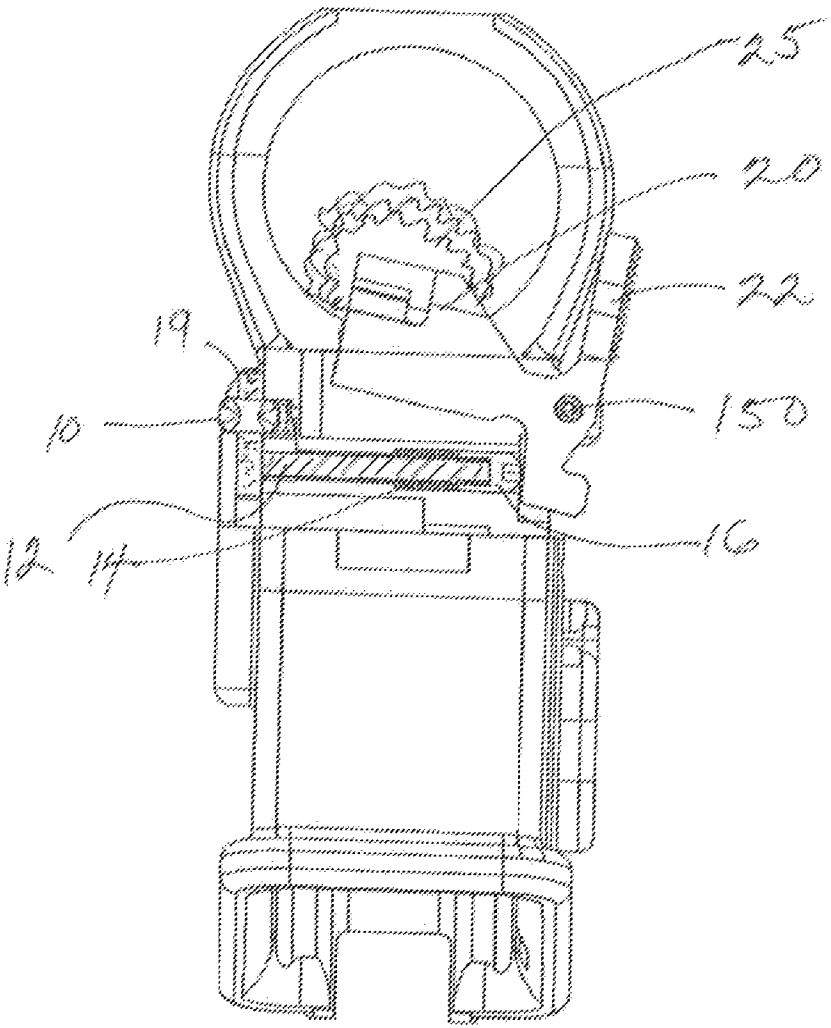
FIG. 7 is a front view of the assembled ambidextrous bolt catch in a raised position retaining the bolt group in a rearward position.

FIG. 7 is a front view of the assembled ambidextrous bolt catch of the present invention with the bolt catch finger 20 in a raised position. The bolt 25 of the firearm has traveled past the bolt catch finger 20 after the final round of ammunition is fired; this causes the plunger 12 to compress spring 14 and plunger head 16 so that bolt catch finger 20 pivots on the pivot pin 150 and raises the bolt catch finger 20 to a position that stops the bolt 25 from traveling forward. Also shown in FIG. 7 is the position of lever 10 held by vertical lever pin 19. The lever 10 does pivot outwards in FIG. 7 when bolt group is in the rearward position; however, the lever 10 does not rotate outwards very far from the lower receiver 40. The outward rotation of lever 10 is illustrated in the enlarged drawing of FIG. 6 showing a top view of the device with lever 10 pivoted outward from the side of the firearm.

When all components are assembled in the lower receiver 40, and there is a magazine 50 removably attached to the lower receiver 40, the ambidextrous bolt catch device functions as follows. First, the bolt 25 of the firearm travels past the bolt catch finger 20 when the final round of ammunition is fired or when the operator pulls lever 10 laterally to the right and away from the side of the lower receiver 40 or manually pulls the knurled pad 22 laterally to the right and away from the left side of the firearm causing the bolt catch finger 20 to rotate upward and stop the bolt 25 from traveling forward.

When the bolt group moves rearward over an empty magazine cartridge, the magazine spring pushes the magazine follower against the bolt catch finger, which mechanically creates a rotational action that causes the bolt catch finger 20 to rotate upward, block the forward movement of the bolt 25 and signal the user of the weapon that the magazine is empty and needs to be replaced or refilled. When the next ammunition round is placed into the weapon, the bolt 25 must be released from the bolt catch finger 20 to allow the bolt 25 to push the ammunition into the chamber of the weapon.

The release of bolt 25 is accomplished manually. On the right side of the firearm, the operator pushes lever 10 towards the sidewall of lower receiver 40 allowing the mechanics of the spring bias plunger rod assembly to rotate the bolt catch finger 20 in a downward rotation, which then releases the bolt 25. On the left side of the firearm, a left-handed user is able to press knurled pad 22 of the bolt catch finger 20 laterally towards the left side of the firearm creating tension on the torsion spring of the plunger rod assembly and cause the rotation of the bolt catch finger in a downward position, releasing the bolt 25.

Thus, when the first release lever and second release lever are pressed or moved laterally toward the right side and the left side of the firearm, the bolt catch finger 20 rotates to a downward position and when the first release lever and second release lever are pulled or moved laterally away from the right side and the left side of the firearm, the bolt catch finger rotates to an upward position. The movement of the first and second levers can be accomplished manually or mechanically. The plunger rod assembly with torsion spring and plunger head allows the creation of tension and subsequent rotation of the bolt catch finger 20 to an upward or downward position, as desired, in the operation of a firearm.

The novel design of the ambidextrous bolt catch device has a right-hand side of the weapon release point (lever 10) and a left-hand side of the weapon release point (knurled pad 22).

The ambidextrous bolt catch device is designed to have a single spring 14 keeping constant resistance on the plunger head 16. When the bolt catch finger 20 is in its raised position, it compresses the spring allowing the plunger 12 to be pushed outwards, and allowing the lever 10 to swing out in a horizontal or lateral direction from the right side of the firearm as shown in FIG. 6.

The bolt catch finger 20 is fabricated from 17-4 gauge stainless steel; carefully machined from a one-piece block that pivots upward and downward on pivot pin 150. The bolt catch finger 20 can also be manufactured using metal injection molding (MIM).

After assembly or manufacture, the ambidextrous bolt catch device of the present invention functions as a unit that does not have loose parts or parts that can fall off involuntarily. The ambidextrous bolt catch device assembly can be installed or removed from a weapon during disassembly and cleaning. This new design allows the operation of a bolt catch device with one hand for either a right-handed or left-handed shooter.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An ambidextrous bolt catch device for firearms, comprising in combination:

a bolt catch finger connected to a receiver of a firearm by a pivot pin;

a first release lever located on a right side of the firearm and attached to the receiver of the firearm with a vertical pin;

a second release lever located on a left side of the firearm and integral to the bolt catch finger; and a plunger rod assembly having a first end abutting a base of the bolt catch finger on the left side of the firearm and a second end connected to the first release lever on the right side of the firearm, thus providing a fully assembled bolt catch device that holds the bolt and bolt carrier in a rearward position and releases the bolt and bolt carrier to move forward and chamber ammunition for the firearm.

2. The bolt catch device of claim 1, wherein the plunger rod assembly includes a torsion spring surrounding the first end of the plunger rod, held in place by a plunger head, the torsion spring creates tension and causes rotation of the bolt catch finger in a downward position when the first release lever and second release lever are pressed laterally toward the right side and the left side of the weapon and when the first release lever and second release lever are pulled laterally away from the right side and the left side of the firearm, the bolt catch finger rotates to an upward position.

3. The bolt catch device of claim 1, wherein the bolt catch finger is shaped from a solid metal.

4. The bolt catch device of claim 3, wherein the solid metal is at least one of steel, stainless steel, and an iron alloy.

5. The bolt catch device of claim 1, wherein the bolt catch finger is fabricated using metal injection molding (MIM).

6. A method of preventing a bolt carrier of a firearm from moving forward after firing ammunition, the method comprising the steps of:

a) moving a first lever and a second lever of an ambidextrous bolt catch device that is attached to a firearm laterally away the first side and the second side of the firearm and simultaneously pushing a plunger rod against the bias of the spring that causes the rotation of a bolt catch finger in an upward position; and b) blocking the forward motion of a bolt and bolt carrier by the bolt catch finger in a upward position.

7. The method of claim 6, wherein the step of moving the first lever and the second lever is accomplished manually with one hand selected from at least one of a right hand and a left hand.

8. The method of claim 6, wherein the step of moving the first lever and the second lever is accomplished mechanically with the rearward movement of the bolt carrier and bolt after the last round of ammunition is fired.

9. A method of releasing a bolt carrier of a firearm for forward movement to chamber ammunition in a firearm, the method comprising the steps of:

a) moving a first lever and a second lever of an ambidextrous bolt catch device that is attached to a firearm laterally toward the first side and the second side of the firearm and releasing pressure on the spring bias of the plunger rod causing the rotation of a bolt catch finger in an downward position; and b) releasing the bolt and bolt carrier to move forward and chamber ammunition in the firearm.

10. The method of claim 9, wherein the step of moving the first lever and second lever is accomplished manually with one hand selected from at least one of a right hand and a left hand.

11. A firearm with bolt catch firing system, comprising: in combination:

a rifle having a magazine receptacle and a removable magazine;

a bolt catch finger connected to a receiver of the rifle by a pivot pin;

a first release lever located on a right side of the rifle and attached to the receiver of the rifle with a vertical pin;

a second release lever located on a left side of the rifle and integral to the bolt catch finger; and a plunger rod assembly having a first end abutting the base of the bolt catch finger on the left side of the rifle and a second end connected to the first release lever on the right side of the rifle, thus providing a fully assembled bolt catch device that holds the bolt and bolt carrier in a rearward position and releases the bolt and bolt carrier to move forward and chamber ammunition for the rifle.

12. The firearm of claim 11, wherein the plunger rod assembly includes a torsion spring surrounding the first end of the plunger rod, held in place by a plunger head, the torsion spring creates tension and causes rotation of the bolt catch finger in a downward position when the first release lever and second release lever are pressed laterally toward the right side and the left side of the weapon and when the first release lever and second release lever are pulled laterally away from the right side and the left side of the rifle, the bolt catch finger rotates to an upward position.

13. The firearm of claim 11, wherein bolt catch finger is shaped from a solid metal.

14. The firearm of claim 13, wherein the solid metal is at least one of steel, stainless steel, and an iron alloy.

15. The firearm of claim 11, wherein the bolt catch finger is fabricated using metal injection molding (MIM).

16. The firearm of claim 11, wherein the rifle is a semi-automatic weapon.

17. The firearm of claim 11, wherein the rifle is a fully automatic weapon.

18. The firearm of claim 11, wherein the rifle is selected from one of a M16 firearm and M4 firearm.

* * * * *